US009815292B2

(12) United States Patent
Zhao

(10) Patent No.: US 9,815,292 B2
(45) Date of Patent: Nov. 14, 2017

(54) PRINTING APPARATUS

(71) Applicant: BOE TECHNOLOGY GROUP CO., LTD., Beijing (CN)

(72) Inventor: Dejiang Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/107,358

(22) PCT Filed: Sep. 16, 2015

(86) PCT No.: PCT/CN2015/089755
§ 371 (c)(1),
(2) Date: Jun. 22, 2016

(87) PCT Pub. No.: WO2016/169197
PCT Pub. Date: Oct. 27, 2016

(65) Prior Publication Data

US 2017/0113468 A1 Apr. 27, 2017

(30) Foreign Application Priority Data

Apr. 22, 2015 (CN) ..... 2015 1 0194869

(51) Int. Cl.
*B41J 2/175* (2006.01)

(52) U.S. Cl.
CPC ..... *B41J 2/17566* (2013.01)

(58) Field of Classification Search
CPC ..... B41J 29/393; B41J 2/17566
See application file for complete search history.

(56) References Cited

U.S. PATENT DOCUMENTS 6,435,638 B1 * 8/2002 Wilson ..... B41J 2/17513 347/7
6,644,794 B1 * 11/2003 Wilson ..... B41J 2/17509 347/86

(Continued)

FOREIGN PATENT DOCUMENTS

CN 1693082 A 11/2005
CN 101117055 A 2/2008

(Continued)

OTHER PUBLICATIONS

First Office Action regarding Chinese Application No. 2015101948699 Nov. 13, 2015. Translation provided by Dragon Intellectual Property Law Firm.

(Continued)

*Primary Examiner* — Lamson Nguyen
(74) *Attorney, Agent, or Firm* — Harness, Dickey & Pierce, P.L.C.

(57) ABSTRACT

A printing apparatus is provided, including: a liquid supply tank for storing and supplying ink, where a liquid supply outlet is arranged on a bottom wall of the liquid supply tank; a liquid level measuring device for measuring a height of a liquid level in the liquid supply tank; a regulating device for regulating an air pressure in the liquid supply tank; and a controller, for controlling the regulating device to regulate the air pressure in the liquid supply tank based on the height of the liquid level measured by the liquid level measuring device and maintaining a pressure at the liquid supply outlet of the liquid supply tank.

14 Claims, 3 Drawing Sheets

(56) References Cited

U.S. PATENT DOCUMENTS

| | | | | |
|---|---|---|---|---|
| 7,794,032 | B2 | 9/2010 | Kimura | |
| 2003/0132980 | A1 * | 7/2003 | Yamazaki | B41J 2/17509 347/19 |

FOREIGN PATENT DOCUMENTS

| | | | |
|---|---|---|---|
| CN | 102164749 | A | 8/2011 |
| CN | 102501606 | A | 6/2012 |
| CN | 103895357 | A | 7/2014 |
| CN | 104411500 | A | 3/2015 |
| CN | 104742528 | A | 7/2015 |
| JP | 2002321390 | A | 11/2002 |
| JP | 2003341028 | A | 12/2003 |

OTHER PUBLICATIONS

Second Office Action regarding Chinese Application No. 2015101948699 dated Jan. 28, 2016. Translation provided by Dragon Intellectual Property Law Firm.

Written Opinion of the International Searching Authority regarding International Application No. PCT/CN2015/089755. Translation provided by Dragon Intellectual Property Law Firm.

* cited by examiner

PRINTING APPARATUS

CROSS-REFERENCE TO RELATED APPLICATIONS

The present application is a national phase of PCT Application No. PCT/CN2015/089755 filed on Sep. 16, 2015, which claims a priority to Chinese Patent Application No. 201510194869.9 filed on Apr. 22, 2015, the disclosure of which are incorporated in their entireties by reference herein.

TECHNICAL FIELD

The present disclosure relates to the field of inkjet printing technology, in particular, to a printing apparatus.

BACKGROUND

The operation principle of inkjet printing technology is printing precisely ink droplets into each pixel through a printing ejection head, which requires that a volume and a landing location of each ink droplet are very accurate. If the ink droplets are not of a uniform volume, a thickness of a film is not uniform, thus leading to linear stripes during displaying.

A pressure at the printing ejection head relates to a height of a liquid level of ink in a liquid supply tank and an air pressure in the liquid supply tank. The height of the liquid level is reduced gradually during a printing process, thus causing gradual decrease of the pressure at the printing ejection head and gradual decrease of the volume of the ink droplet ejected from the printing ejection head. Hence, the volume of an ink droplet ejected initially greatly differs from the volume of an ink droplet ejected finally, thereby causing nonuniform printing.

SUMMARY

It is provided a printing apparatus according to embodiments of the present disclosure, with this printing apparatus, volumes of ejected ink droplets during a printing process are relatively uniform and the printing performance is good.

In order to achieve the above objectives, following technical solutions are provided in the present disclosure.

A printing apparatus is provided, including:

- a liquid supply tank for storing and supplying ink, where a liquid supply outlet is arranged on a bottom wall of the liquid supply tank;
- a liquid level measuring device for measuring a height of a liquid level in the liquid supply tank;
- a regulating device for regulating an air pressure in the liquid supply tank; and
- a controller, for controlling, based on the height of the liquid level measured by the liquid level measuring device, the regulating device to regulate the air pressure in the liquid supply tank and maintaining a pressure at the liquid supply outlet of the liquid supply tank.

The pressure at the liquid supply outlet relates to the height of the liquid level in the liquid supply tank and the air pressure in the liquid supply tank. The height of the liquid level in the liquid supply tank changes gradually during a printing process, thus causing change of the pressure at the liquid supply outlet. By means of continually regulating the air pressure in the liquid supply tank, the pressure at the liquid supply outlet may remain unchanged while the height of the liquid level in the liquid supply tank changes continuously. Therefore, the printing apparatus is provided with the regulating device for regulating the air pressure in the liquid supply tank 1 and the controller for controlling the regulating device, an algorithm is applied to the controller, such that, on reception of a signal about the height of the liquid level transmitted from the liquid level measuring device, the controller can calculate, based on a change of the height of the liquid level, a change by which the pressure is to be regulated, and control the regulating device to regulate the air pressure in the liquid supply tank according to the calculating result. During a printing process, with the continual regulation performed by the regulating device on the air pressure in the liquid supply tank, the pressure at the liquid supply outlet may remain unchanged, and consequently, volumes of ink droplets ejected from the liquid supply outlet are relatively uniform.

Accordingly, during a printing process of the printing apparatus, volumes of ejected ink droplets are relatively uniform and the printing performance is good.

Optionally, the printing apparatus may further include: a liquid inlet duct, an end of which is in communication with the liquid supply tank. In a case that the height of the liquid level of a liquid in the liquid supply tank is equal to or lower than a first predetermined height, the liquid is injected into the liquid supply tank through the liquid inlet duct such that the height of the liquid level in the liquid supply tank is increased to a second predetermined height.

Optionally, the first predetermined height may be lower than the second predetermined height.

Optionally, a first valve may be arranged on the liquid inlet duct, the first valve is controlled by the controller to be opened if the height of the liquid level in the liquid supply tank is equal to or lower than the first predetermined height, and the first valve is controlled by the controller to be closed if the height of the liquid level in the liquid supply tank is equal to the second predetermined height.

Optionally, the printing apparatus may further include: a first liquid level sensor, which is arranged on the liquid supply tank at a position of the first predetermined height and is used to sense whether or not the height of the liquid level in the liquid supply tank is equal to the first predetermined height.

Optionally, the printing apparatus may further include: a second liquid level sensor, which is arranged on the liquid supply tank at a position of the second predetermined height and is used to sense whether or not the height of the liquid level in the liquid supply tank is equal to the second predetermined height.

Optionally, the liquid is added to the liquid supply tank each time a preset volume of the liquid is used up during printing, and the preset volume may equal to a capacity of the liquid supply tank between the first predetermined height and the second predetermined height.

Optionally, the printing apparatus may further include an excess liquid outlet duct, an end of which is in communication with the liquid supply tank.

Optionally, a second valve may be arranged on the excess liquid outlet duct. The second valve is controlled by the controller to be opened if the height of the liquid level in the liquid supply tank is higher than the second predetermined height, and the second valve is controlled by the controller to be closed if the height of the liquid level in the liquid supply tank is equal to the second predetermined height.

Optionally, an opening at which the excess liquid outlet duct is in communication with the liquid supply tank is located at a position of the second predetermined height.

Optionally, the printing apparatus may further include an excess liquid temporary storage tank in communication with the other end of the excess liquid outlet duct.

Optionally, the liquid may be the ink.

Optionally, the printing apparatus may further include an ink tank, which is used to store the ink and is in communication with another end of the liquid inlet duct.

Optionally, the regulating device may be a micro vacuum regulating device.

DETAILED DESCRIPTION OF THE EMBODIMENTS

Unless otherwise defined, any technical or scientific terms used herein shall have the common meaning understood by a person of ordinary skills. Such words as "first" and "second" used in the specification and claims are merely used to differentiate different components rather than to represent any order, number or importance. Similarly, such words as "a" or "an" are merely used to represent the existence of at least one member, rather than to limit the number thereof. Such words as "connect" or "connected to" are not limited to physical or mechanical connection and may further include electrical connection; the connections can be either direct or indirect. Such words as "on/above", "under/below", "left" and "right" are merely used to represent relative position relationship, and when an absolute position of an object is changed, the position relationship with respect to the object is changed accordingly.

Technical solutions of the present disclosure will be described hereinafter in a clear and complete manner in conjunction with drawings used in embodiments of the present disclosure. Obviously, the following embodiments are merely a part of, rather than all of, the embodiments of the present application. All other embodiments obtained by a person skilled in the art based on the disclosed embodiments herein without applying inventive efforts are within the protective scope of the present disclosure.

Figure 1:
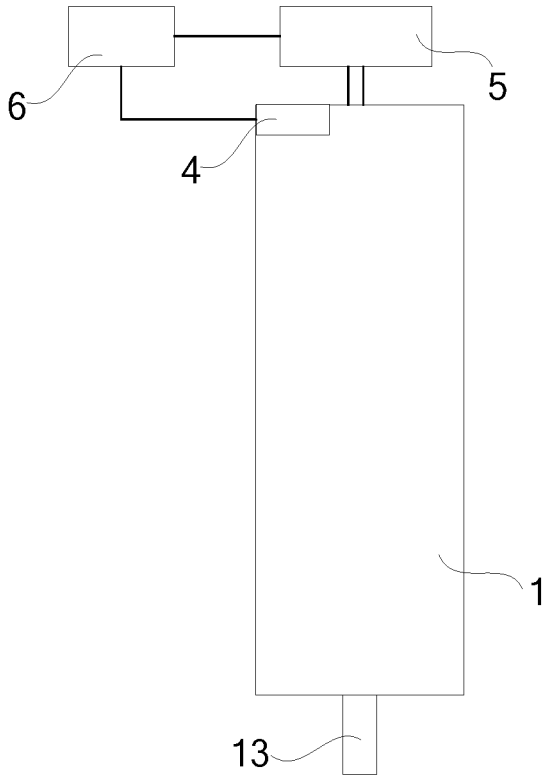
FIG. 1 is a schematic structural diagram of a printing apparatus according to an embodiment of the present disclosure.
Figure 2:
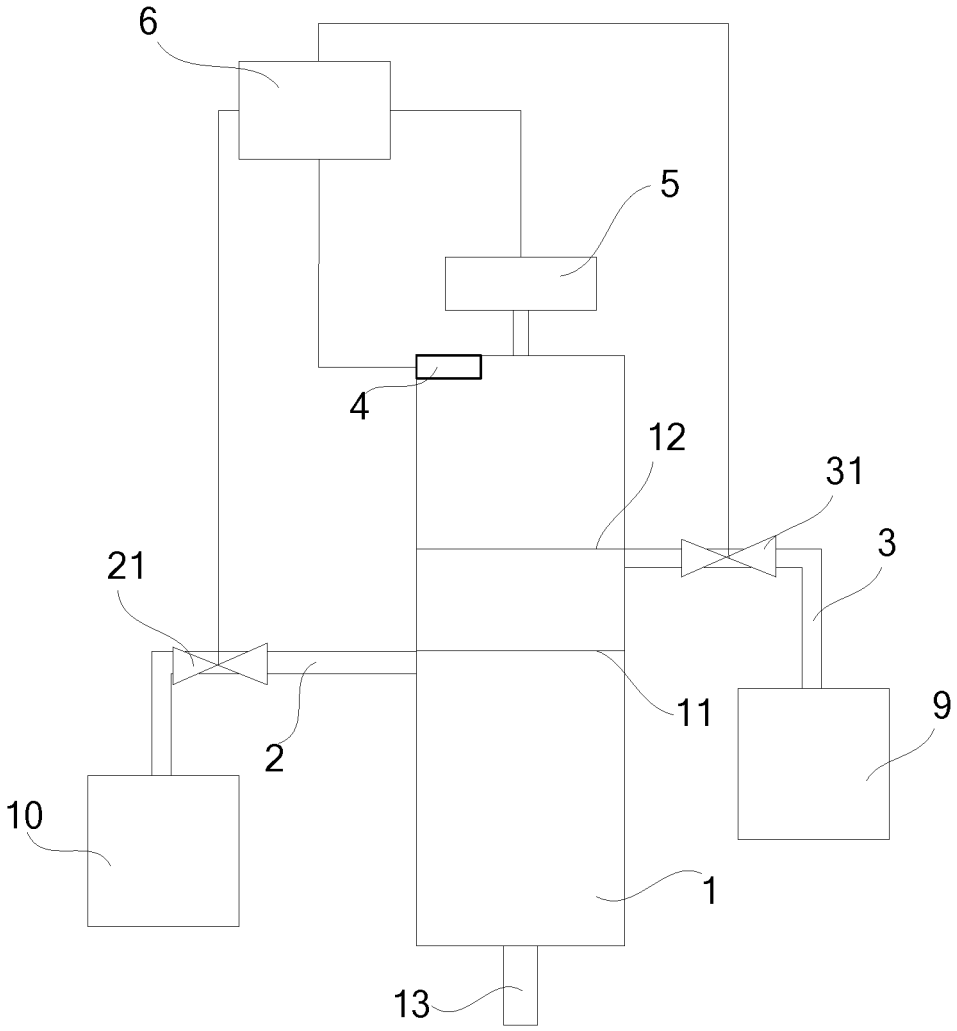
FIG. 2 is a schematic structural diagram of a printing apparatus according to an embodiment of the present disclosure.
Figure 3:
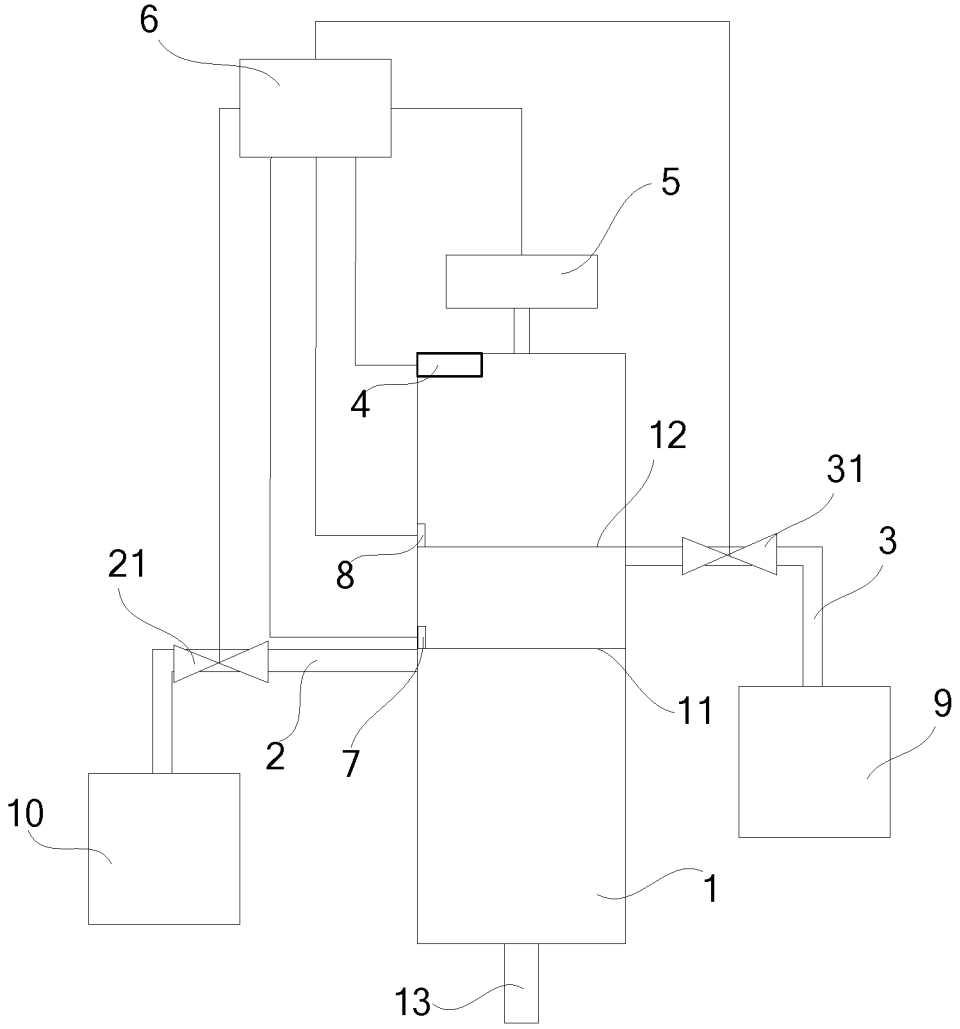
FIG. 3 is a schematic structural diagram of a printing apparatus according to an embodiment of the present disclosure.

As shown in FIG. 1, FIG. 2 and FIG. 3, a printing apparatus is provided according to some embodiments of the present disclosure. The printing apparatus includes:

- a liquid supply tank 1 for storing and supplying ink, where a liquid supply outlet 13 is arranged on a bottom wall of the liquid supply tank 1;
- a liquid level measuring device 4 for measuring a height of a liquid level in the liquid supply tank 1;
- a regulating device 5 for regulating an air pressure in the liquid supply tank 1; and
- a controller 6, connected with the liquid level measuring device 4 and the regulating device 5, for controlling, based on the height of the liquid level measured by the liquid level measuring device 4, the regulating device 5 to regulate the air pressure in the liquid supply tank 1 and maintaining a pressure at the liquid supply outlet 13 of the liquid supply tank 1.

Specifically, the regulating device 5 may be a micro vacuum regulating device.

The pressure at the liquid supply outlet 13 relates to the height of the liquid level in the liquid supply tank 1 and the air pressure in the liquid supply tank 1. The height of the liquid level in the liquid supply tank 1 changes gradually during a printing process, thus causing change of the pressure at the liquid supply outlet 13. By means of continually regulating the air pressure in the liquid supply tank 1, the pressure at the liquid supply outlet 13 may remain unchanged while the height of the liquid level in the liquid supply tank 1 changes continuously. Therefore, the printing apparatus is provided with the regulating device 5 for regulating the air pressure in the liquid supply tank 1 and the controller 6 for controlling the regulating device 5, an algorithm is applied to the controller 6, such that, on reception of a signal about the height of the liquid level transmitted from the liquid level measuring device 4, the controller 6 can calculate, based on a change of the height of the liquid level, a change by which the pressure is to be regulated, and control the regulating device 5 to regulate the air pressure in the liquid supply tank 1 according to the calculating result. During a printing process, with the continual regulation performed by the regulating device 5 on the air pressure in the liquid supply tank 1, the pressure at the liquid supply outlet 13 may remain unchanged, and consequently, volumes of ink droplets ejected from the liquid supply outlet 13 are relatively uniform.

Accordingly, during a printing process of the printing apparatus, volumes of ejected ink droplets are relatively uniform and the printing performance is good.

In a specific embodiment, as shown in FIG. 2 and FIG. 3, the printing apparatus further includes: a liquid inlet duct 2, an end of which is in communication with the liquid supply tank 1. In a case that the height of the liquid level of ink in the liquid supply tank 1 is equal to or lower than a first predetermined height, the ink is injected into the liquid supply tank 1 through the liquid inlet duct 2 such that the height of the liquid level in the liquid supply tank 1 is increased to a second predetermined height.

For the printing apparatus above-mentioned, a relationship among the height of the liquid level in the liquid supply tank 1, the air pressure in the liquid supply tank 1 and the pressure at the liquid supply outlet 13 is analyzed through experiments. Two heights of the liquid level may be selected depending on following conditions: in a case that the pressure at the liquid supply outlet 13 remains unchanged, when the liquid level in the liquid supply tank 1 varies between the two heights, a change of the height of the liquid level in the liquid supply tank 1 is approximately in a linear relationship with a change of the air pressure in the liquid supply tank 1, i.e., the algorithm applied to the controller 6 is a linear equation. A smaller one of the two heights is set as the first predetermined height, and a bigger one is set as the second predetermined height. For purpose of convenient observation, these predetermined heights may be marked on a side wall of the liquid supply tank 1. As shown in FIG. 2, a first predetermined height line 11 is marked on the liquid supply tank 1 for representing the first predetermined height of the liquid level, and a second predetermined height line 12 is marked on the liquid supply tank 1 for representing the second predetermined height of the liquid level. In the case that the algorithm applied to the controller 6 is a linear equation, it is necessary to ensure that the liquid level in the liquid supply tank 1 changes between the first predetermined height line 11 and the second predetermined height line 12 during a printing process, such that the pressure at the liquid supply outlet 13 remains unchanged. Here, the height of the liquid level may be increased to the second predetermined height line 12 by adding ink through the liquid inlet duct 2 before each printing process.

As shown in FIG. 2 and FIG. 3, in a specific embodiment based on the embodiment above-described, a first valve 21 may be arranged on the liquid inlet duct 2. Signals can be transmitted between the controller 6 and the first valve 21, and the controller 6 controls the first valve 21 to be opened if the height of the liquid level height in the liquid supply tank 1 is equal to or lower than the first predetermined height and controls the first valve 21 to be closed if the height of the liquid level in the liquid supply tank 1 is equal to the second predetermined height.

In the embodiment, whether or not liquid can be added via the liquid inlet duct 2 can be controlled by the controller 6 and the first valve 21, and the height of the liquid level measured by the liquid level measuring device 4 serves as a signal for determining whether or not the liquid needs to be added. The controller 6 may control the first valve 21 to be opened such that ink can enter the liquid supply tank through the liquid inlet duct 2, if the height of the liquid level measured by the liquid level measuring device 4 is equal to or lower than the first predetermined height, and the controller 6 may control the first valve 21 to be closed such that ink stops entering the liquid supply tank, if the height of the liquid level measured by the liquid level measuring device 4 is equal to the second predetermined height. Therefore, using the liquid level measuring device 4, the controller 6 and the first valve 21, the ink can be automatically added into the liquid supply tank 1 via the liquid inlet duct 2 if the liquid level in the liquid supply tank 1 is not higher than the first predetermined height line 11 and the adding of the ink stops when the liquid level in the liquid supply tank 1 reaches the second predetermined height line 12.

As shown in FIG. 3, in an optional embodiment based on the embodiment above-described, the printing apparatus may further include a first liquid level sensor 7 arranged on the liquid supply tank 1 at the position of the first predetermined height line 11, which is used to sense whether or not the height of the liquid level in the liquid supply tank 1 is equal to the first predetermined height. The first liquid level sensor 7 can communicate with the controller 6 through signals and may transmit a sensing signal to the controller 6. Therefore, the sensing signal of the first liquid level sensor 7 may serve as a control signal for opening the first valve 21. When the liquid level is at the first predetermined height line 11, the first liquid level sensor 7 can generate a sensing signal and transmit the sensing signal to the controller 6, and the controller 6, on reception of the sensing signal, can control the first valve 21 to be opened such that ink can enter the liquid supply tank through the liquid inlet duct.

As shown in FIG. 3, in an optional embodiment, the printing apparatus may further include a second liquid level sensor 8 arranged on the liquid supply tank 1 at the position of the second predetermined height line 12, which is used to sense whether or not the height of the liquid level in the liquid supply tank 1 is equal to the second predetermined height. The second liquid level sensor 8 can communicate with the controller 6 through signals and may transmit a sensing signal to the controller. Similarly, when the liquid level is at the second predetermined height line 12, the second liquid level sensor 8 can generate a sensing signal and transmit the sensing signal to the controller 6, and the controller 6, on reception of the sensing signal, can control the first valve 21 to be closed such that the ink is stopped from entering the liquid supply tank.

In view of the above, using the first liquid level sensor 7, a second liquid level sensor 8, the controller 6 and the first valve 21, the ink can be automatically added into the liquid supply tank 1 via the liquid inlet duct 2 if the liquid level in the liquid supply tank 1 is at the first predetermined height line 11 and the liquid level may reach the second predetermined height line 12. Therefore, the liquid level may be remained between the first predetermined height line 11 and the second predetermined height line 12 during a printing process.

In an optional embodiment based on each embodiment above-described, with the printing apparatus, ink can be added to the liquid supply tank 1 each time a preset volume of ink is used up during printing, the preset volume may equal to a capacity of the liquid supply tank 1 between the first predetermined height line 11 and the second predetermined height line 12. Thus, the liquid level is at the second predetermined height line 12 before each printing process and reaches the first predetermined height line 11 just when the preset volume of ink is used up during printing; then, ink is added and the liquid level reaches the second predetermined height line 12 for performing a subsequent printing operation.

In an alternative embodiment, the liquid level may be examined after each printing process. Ink is added such that the liquid level reaches the second predetermined height line 12 if the examined liquid level is located between the first predetermined height line 11 and the second predetermined height line 12 and ink volume between the examined liquid level and the first predetermined height line 11 is not enough for a next printing process.

As shown in FIG. 2 and FIG. 3, in a specific embodiment based on the embodiments above-described, the printing apparatus may further include an excess liquid outlet duct 3, an end of which is in communication with the liquid supply tank 1. A second valve 31 may be arranged on the excess liquid outlet duct 3, and signals can be transmitted between the second valve 31 and the controller 6. The controller 6 controls the first valve 31 to be opened if the height of the liquid level in the liquid supply tank 1 is greater than the second predetermined height, and controls the first valve 31 to be closed if the height of the liquid level in the liquid supply tank 1 is equal to the second predetermined height.

In the embodiment, the height of the liquid level measured by the liquid level measuring device 4 may serve as a control signal for controlling ink to flow out. The controller 6 may control the second valve 31 to be opened such that ink flows out of the liquid supply tank 1 through the excess liquid outlet duct 3 if the height of the liquid level measured by the liquid level measuring device 4 is greater than the second predetermined height, and the controller 6 may control the second valve 31 to be closed such that ink stops from flowing out of the liquid supply tank 1 if the height of the liquid level measured by the liquid level measuring device 4 is equal to the second predetermined height. Alternatively, the controller 6 controls the second valve 31 to be closed if the second liquid level sensor 8 senses that the liquid level in the liquid supply tank 1 is at the second predetermined height line 12. In summary, using the liquid level measuring device 4, the controller 6 and the second valve 31, ink can flow out through the excess liquid outlet duct 3 if the height of the liquid level in the liquid supply tank 1 is greater than the second predetermined height, such that the liquid level is lowered to the second predetermined height line 12.

As shown in FIG. 2 and FIG. 3, in an optional embodiment based on embodiment above-described, an opening where the excess liquid outlet duct 3 is in communication with the liquid supply tank 1 may be arranged at the position of the second predetermined height line 12.

As shown in FIG. 2 and FIG. 3, in an optional embodiment based on embodiments above-described, the printing apparatus may further include an excess liquid temporary storage tank 9 in communication with another end of the excess liquid outlet duct 3. If the opening where the excess liquid outlet duct 3 is in communication with the liquid supply tank 1 is located at the position of the second predetermined height line 12 and heights of the excess liquid outlet duct 3 and the excess liquid temporary storage tank 9 are both lower than the second predetermined height, when the liquid level in the liquid supply tank 1 is higher than the second predetermined height line 12, the liquid flows automatically into the excess liquid temporary storage tank 9 through the excess liquid outlet duct 3; thus, the liquid level in the liquid supply tank 1 is maintained to be not greater than the second height line 12 without control of the second valve 31.

As shown in FIG. 2 and FIG. 3, in an optional embodiment based on embodiments above-described, the printing apparatus may further include an ink tank 10, which is used to store ink and is in communication with another end of the liquid inlet duct 2.

It is obvious to those skilled in the art that various modifications and variations of the present disclosure can be made without departing from the spirit and scope of the present disclosure. Thus, provided that such modifications and variations of the present disclosure fall within the scope of the appended claims of the present disclosure and their equivalents, the present disclosure also intends to include those modifications and variations.

What is claimed is:

1. A printing apparatus, comprising:

a liquid supply tank for storing and supplying ink, wherein a liquid supply outlet is arranged on a bottom wall of the liquid supply tank;

a liquid level measuring device for measuring a height of a liquid level in the liquid supply tank;

a regulating device for regulating an air pressure in the liquid supply tank; and a controller, for controlling, based on the height of the liquid level measured by the liquid level measuring device, the regulating device to regulate the air pressure in the liquid supply tank and maintaining a pressure at the liquid supply outlet of the liquid supply tank.

2. The printing apparatus according to claim 1, further comprising:

a liquid inlet duct, an end of which is in communication with the liquid supply tank;

wherein in the case that the height of the liquid level of a liquid in the liquid supply tank is equal to or lower than a first predetermined height, the liquid is injected into the liquid supply tank through the liquid inlet duct such that the height of the liquid level in the liquid supply tank is increased to a second predetermined height.

3. The printing apparatus according to claim 2, wherein the first predetermined height is lower than the second predetermined height.

4. The printing apparatus according to claim 2, wherein a first valve is arranged on the liquid inlet duct;

wherein the first valve is controlled by the controller to be opened in the case that the height of the liquid level in the liquid supply tank is equal to or lower than the first predetermined height, and the first valve is controlled by the controller to be closed in the case that the height of the liquid level in the liquid supply tank is equal to the second predetermined height.

5. The printing apparatus according to claim 4, further comprising:

a first liquid level sensor, which is arranged on the liquid supply tank at a position of the first predetermined height and is configured to sense whether or not the height of the liquid level in the liquid supply tank is equal to the first predetermined height.

6. The printing apparatus according to claim 5, further comprising:

a second liquid level sensor, which is arranged on the liquid supply tank at a position of the second predetermined height and is configured to sense whether or not the height of the liquid level in the liquid supply tank is equal to the second predetermined height.

7. The printing apparatus according to claim 2, wherein the liquid is added to the liquid supply tank each time a preset volume of the liquid is used up during printing, and the preset volume is equal to a capacity of the liquid supply tank between the first predetermined height and the second predetermined height.

8. The printing apparatus according to claim 2, further comprising: an excess liquid outlet duct having an end in communication with the liquid supply tank.

9. The printing apparatus according to claim 8, wherein a second valve is arranged on the access liquid outlet duct;

wherein the second valve is controlled by the controller to be opened in the case that the height of the liquid level in the liquid supply tank is higher than the second predetermined height, and the second valve is controlled by the controller to be closed in the case that the height of the liquid level in the liquid supply tank is equal to the second predetermined height.

10. The printing apparatus according to claim 8, wherein an opening at which the excess liquid outlet duct is in communication with the liquid supply tank is located at a position of the second predetermined height.

11. The printing apparatus according to claim 8, further comprising an excess liquid temporary storage tank in communication with the other end of the excess liquid outlet duct.

12. The printing apparatus according to claim 2, wherein the liquid is the ink.

13. The printing apparatus according to claim 12, further comprising an ink tank which is configured to store the ink and is in communication with another end of the liquid inlet duct.

14. The printing apparatus according to claim 1, wherein the regulating device is a micro vacuum regulating device.

* * * * *